US006778199B2

(12) United States Patent
Hibino

(10) Patent No.: US 6,778,199 B2
(45) Date of Patent: Aug. 17, 2004

(54) THERMAL TRANSFER RECORDING DEVICE AND METHOD THEREFOR

(75) Inventor: Ikuo Hibino, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/395,521

(22) Filed: Mar. 24, 2003

(65) Prior Publication Data

US 2003/0179275 A1 Sep. 25, 2003

(30) Foreign Application Priority Data

Mar. 25, 2002 (JP) ..... 2002-083170

(51) Int. Cl.[7] ..... B41J 2/325
(52) U.S. Cl. ..... 347/176
(58) Field of Search ..... 347/171, 172, 347/174, 176, 221; 400/120.01, 120.02, 120.04

(56) References Cited

U.S. PATENT DOCUMENTS 6,064,413 A * 5/2000 Fukui et al. ..... 347/171

6,082,913 A 7/2000 Yamamoto et al.

* cited by examiner

*Primary Examiner*—Huan Tran

(74) *Attorney, Agent, or Firm*—Brinks Hofer Gilson & Lione

(57) ABSTRACT

A thermal transfer recording device which records a full color image through a single recording operation with a remarkably improved recording efficiency and less power consumption. The recording device uses, as a recording medium, a heat-sensitive recording medium which colors when heated, and has a control unit to control electric energy supplied to heating elements in a line thermal head according to image data in a way to bring its level into: a white range in which the recording medium does not turn black and thermal transfer inks of an ink ribbon are not transferred; a color range in which the recording medium does not turn black and the thermal transfer inks are transferred; or a black range in which the recording medium turns black.

2 Claims, 3 Drawing Sheets

THERMAL TRANSFER RECORDING DEVICE AND METHOD THEREFOR

BACKGROUND OF THE INVENTION

1. Field of the Invention

The present invention relates to a thermal transfer recording device and more particularly to a thermal transfer recording device which enables full color recording with a single recording operation using a thermal head.

2. Description of the Related Art

Thermal transfer recording devices have been widely used where a plurality of heating elements in a thermal head are selectively activated and heated according to image data to transfer ink from the ink ribbon to a recording medium to record a desired image.

Recently, among these thermal transfer recording devices, line printers have been spreading due to the growing demand for compactness. In a line printer, a line thermal head whose length matches the recording media's recording area width is pressed against a platen roller with the recording media and ink ribbon between them to perform recording.

This type of line printer uses an ink ribbon which bears cyan, magenta, and yellow inks successively in a cyclic pattern and transfers these color inks onto the recording medium in a way for them to overlap each other to record a full color image.

For full color image recording in this type of line printer, while the line thermal head is pressed against the platen roller with the recording medium and ink ribbon between them, a plurality of heating elements in the line thermal head are selectively heated according to image data and at the same time the platen roller is rotated to move the recording medium and the ink ribbon so that a first color ink is transferred from the ink ribbon to the recording medium to record the desired image on the medium.

After completion of recording with the first color ink, the line thermal head is separated from the platen roller, the paper feed roller is rotated in the reverse direction to move back the recording medium by a prescribed amount while the ink ribbon is not rewound.

Then, as in the above procedure, while the line thermal head is pressed against the platen roller with the recording medium and ink ribbon between them, the heating elements in the line thermal head are selectively heated and the recording medium and the ink ribbon are moved, so a desired image is printed on the recording medium. The above procedure takes place for each color ink of the ink ribbon so that a full color image is recorded on the recording medium.

However, the conventional thermal transfer recording device as mentioned above has the problem that because the procedure (recording operation) is repeated for each of cyan, magenta and yellow inks, it takes a considerable time to record a full color image. In other words, it is very low in recording efficiency.

In addition, since the recording operation has to be repeated for each color, power consumption is considerable. Recently, portable recording devices have been becoming popular. If this method should be used in a portable recording device, it would cause inconvenience in use because it consumes much battery power and cannot be used for a long time.

SUMMARY OF THE INVENTION

The present invention has been made in view of the above circumstances. One object of the present invention is to provide a thermal transfer recording device which enables full color recording with a single recording operation and thus increases the recording efficiency remarkably and reduces power consumption, and a method therefor.

Another object of the present invention is to provide a thermal transfer recording device having a thermal head for recording a desired image or the like on a recording medium, in which, while the thermal head or the recording medium is moving at a prescribed speed with the thermal head pressed against the recording medium with an ink ribbon bearing thermal transfer inks between them, heating elements in the thermal head are selectively activated according to image data to make them generate heat in order to record a desired image or the like. The recording device uses, as the recording medium, a heat-sensitive recording medium which colors when heated, and has control means to control electric energy supplied to the heating elements in the thermal head. Here, the control means control the electric energy supplied to the heating elements according to the image data in a way to bring its level into one of the following ranges: a white range in which the recording medium does not turn black and the thermal transfer inks of the ink ribbon are not transferred; a color range in which the recording medium does not turn black and the thermal transfer inks are transferred; or a black range in which the recording medium turns black.

In this case, the control means control the electric energy supplied to the thermal head to bring its level into the white, color or black range depending on image data to record a full color image and recording of a full color image is performed through a single recording operation. This remarkably increases the recording speed, remarkably improves the recording efficiency and reduces power consumption.

A further object of the present invention is to provide a thermal transfer recording device as mentioned above in which the thermal head is a line thermal head, and the ink ribbon includes successive lines of R, G, and B thermal transfer inks extending along a row of heating elements in the line thermal head.

According to the invention, when the thermal head is a line thermal head and the ink ribbon includes successive lines of R, G, and B thermal transfer inks extending along a row of heating elements in the line thermal head, a line printer capable of recording full color images is realized.

DETAILED DESCRIPTION OF THE PREFERRED EMBODIMENTS

Next, preferred embodiments of the present invention will be described referring to FIG. 1 to FIG. 5.

Figure 1:
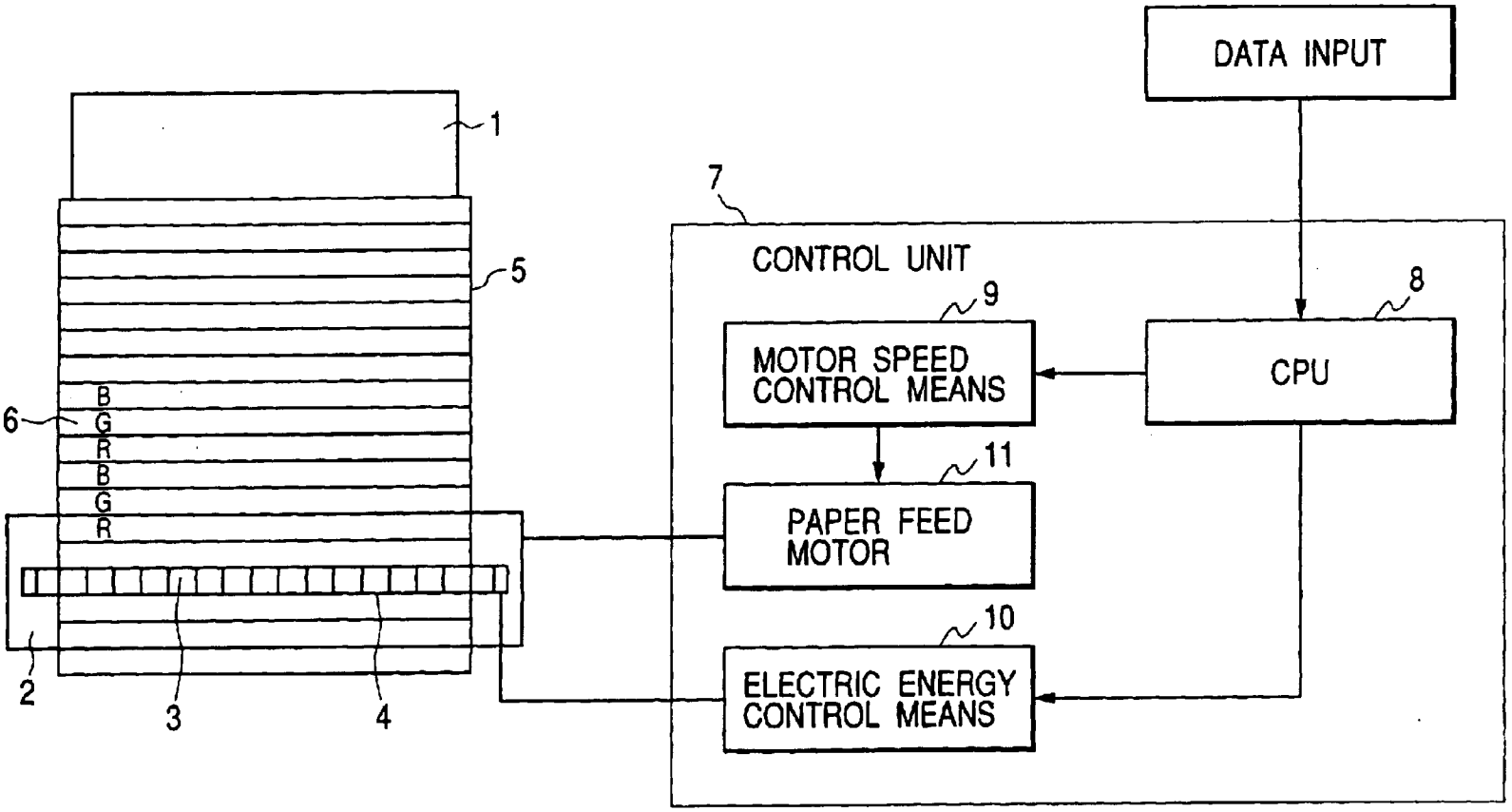
FIG. 1 shows the general structure of a thermal transfer recording device according to one embodiment of the present invention.

FIG. 1 shows a thermal transfer recording device according to one embodiment of the present invention where the recording device is a line printer.

This thermal transfer recording device has a platen roller 2 for feeding a recording medium 1, near which there is a line thermal head 4 having a plurality of heating elements 3 in a row perpendicular to the direction of feeding the recording medium 1. The line thermal head 4 is designed to be pressed against the platen roller 2 with an ink ribbon 5 and the recording medium 1 between them.

In this embodiment, the recording medium 1 is a heat-sensitive recording medium whose color changes from white to black as the heating elements 3 in the line thermal head 4 generate heat, such as heat-sensitive paper, a heat-sensitive sheet or heat-sensitive film.

The ink ribbon 5 includes successive lines of R (red), G (green) and B (blue) thermal transfer inks 6 extending cyclically along the row of heating elements 3 in the line thermal head 4, where the width of each of the R, G, and B thermal transfer ink lines 6 is between 10 $\mu$m and 100 $\mu$m or so. Alternatively, the R, G, and B ink lines of the ink ribbon 5 may be perpendicular to the row of heating elements 3.

Furthermore, in this embodiment, there is a control unit 7 as a means to control various parts of the thermal transfer recording device according to given image data which is entered. This control unit 7 has a CPU 8. The CPU 8 is connected with a motor speed control means 9 and an electric energy control means 10. The motor speed control means 9 is connected with a paper feed motor 11 for rotating the platen roller 2 and the electric energy control means 10 is connected with the line thermal head 4.

Figure 2:
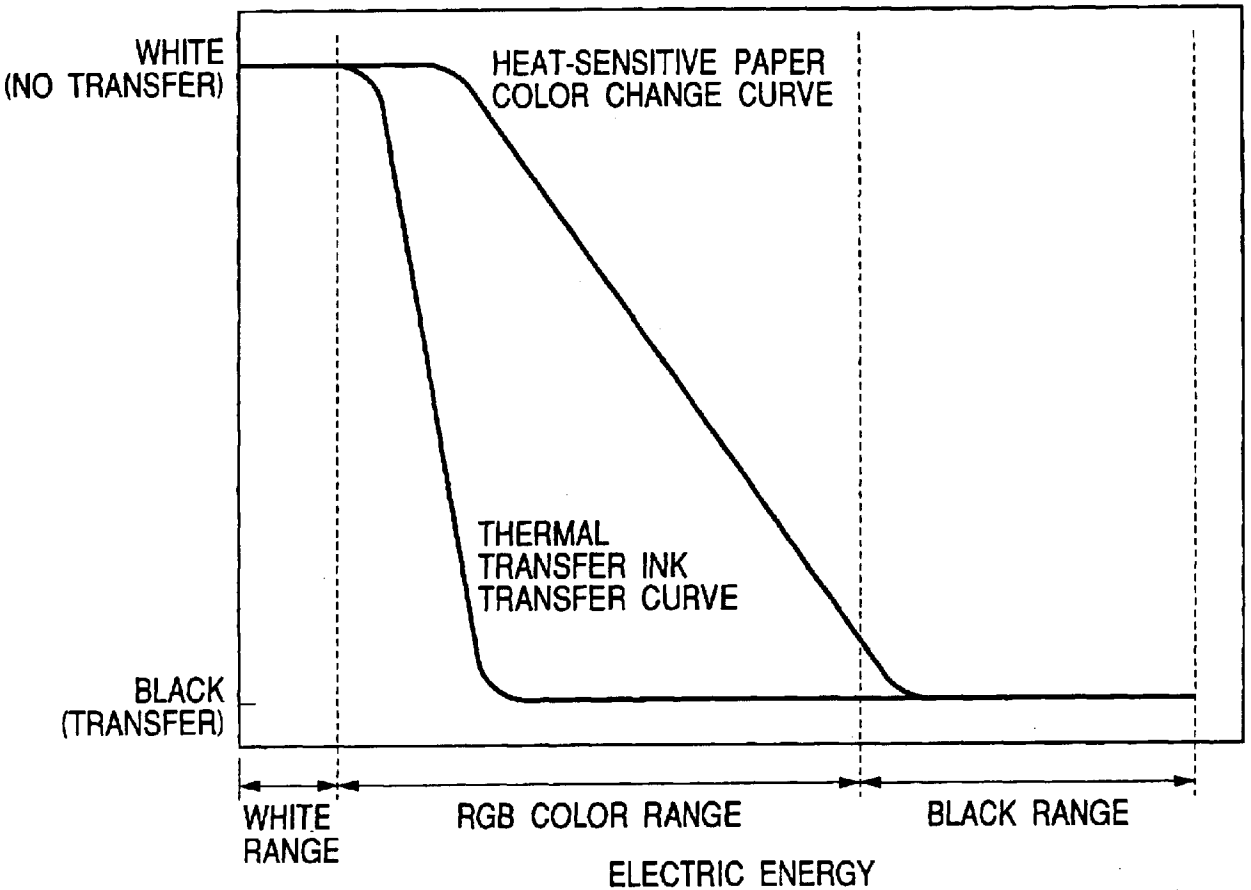
FIG. 2 is a graph showing how a heat-sensitive recording medium turns black and thermal transfer inks are transferred depending on the level of electric energy supplied to heating elements.

FIG. 2 shows how the heat-sensitive recording medium 1 turns black and the thermal transfer inks 6 are transferred depending on the level of electric energy supplied to the heating elements 3.

As can be understood from this graph, when electric energy is supplied to the recording medium 1, its color changes from white to black in proportion to the level of the supplied electric energy. On the other hand, when the level of the electric energy supplied to the heating elements 3 is very low, the thermal transfer inks 6 are not transferred and, when the energy is above a certain level, they are transferred.

The electric energy control means 10 of the control unit 7 controls the electric energy to be supplied to the heating elements 3. In this embodiment, the electric energy to be supplied to the heating elements 3 in the line thermal head 4 is controlled based on the above-mentioned characteristics of the recording medium 1 and the thermal transfer inks 6.

Figure 3:
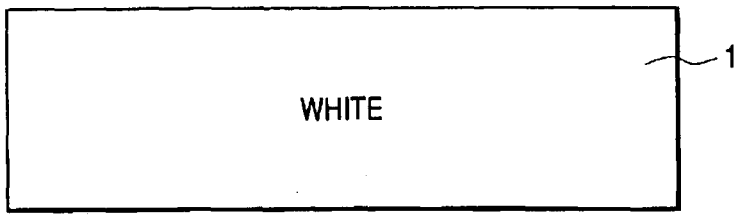
FIG. 3 illustrates how recording is done with the electric energy level in a white range according to a thermal transfer recording method in the present invention.

To record white, no electric energy is supplied to the heating elements 3 or a very low level of electric energy (white range) is supplied in a way not to cause transfer of the thermal transfer inks 6 and not for the recording medium 1 to turn black. As a result, the recording medium 1 remains white without transfer of the thermal transfer inks 6, as shown in FIG. 3.

Figure 4:
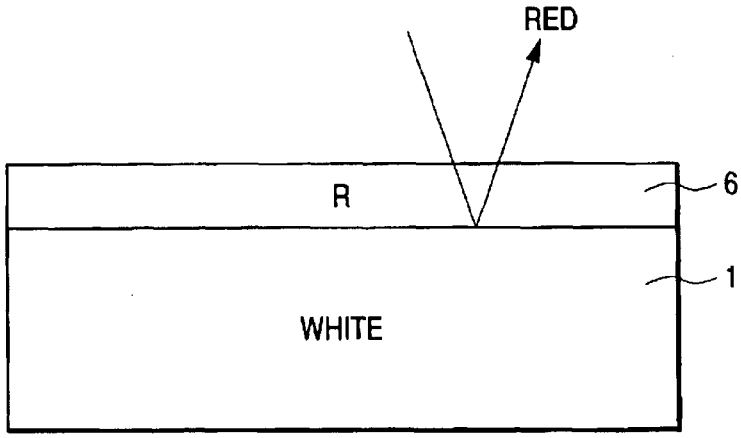
FIG. 4 illustrates how recording is done with the electric energy level in an RGB color range according to the thermal transfer recording method in the present invention.

To record a color with R, G, and B inks, the level of electric energy is controlled so that the thermal transfer inks 6 are transferred but the recording medium 1 is white or light gray. As a result, R, G, B thermal transfer inks 6 are transferred on the surface of the recording medium 1 which is white or light gray, as shown in FIG. 4. Here, when external light is cast on the medium, the light is reflected on the surface of the recording medium 1 because it is white or light gray, and therefore a viewer can recognize the color of the thermal transfer inks 6. In this way, a specific color is recorded. In this case, the reflection of external light on the surface of the recording medium 1 can be weakened by controlling the electric energy supplied to the recording medium 1 so as to make it dark gray. Doing so causes the viewer to recognize the color of the thermal transfer inks 6 transferred on the surface of the recording medium 1 as a weaker color, which enables representation of a color with a specific tone. When each picture element is made up of R, G, and B inks as in this case, a full color image can be recorded by controlling the tone of each color (RGB color range).

Figure 5:
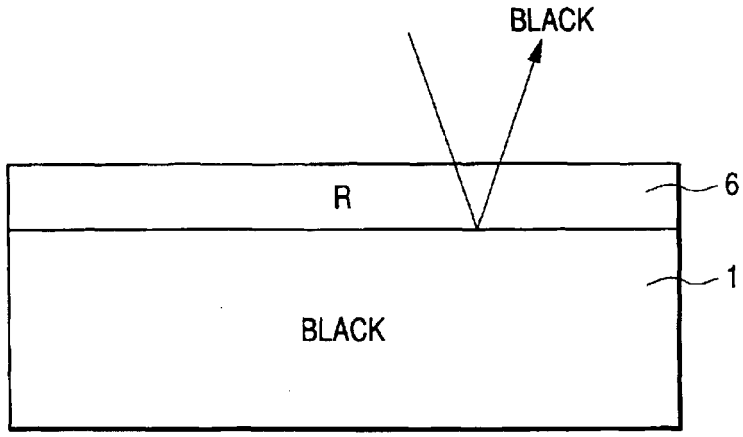
FIG. 5 illustrates how recording is done with the electric energy level in a black range according to the thermal transfer recording method in the present invention.

To record black, the level of the supplied electric energy is controlled so as for the recording medium 1 to turn black (black range). As shown in FIG. 5, this causes the thermal transfer inks 6 to be transferred on the surface of the recording medium 1; however, even when external light is cast on the surface of the recording medium 1, the light is not reflected because the recording medium 1 is black, and thus the thermal transfer inks 6 are invisible. Black is recorded in this way.

Next, an explanation will be given of a thermal transfer recording method according to the present invention, which is used in the above-mentioned thermal transfer recording device.

In this embodiment, as image data is sent to the CPU 8 of the control unit 7 while the line thermal head 4 is pressed against the platen roller 2 with the recording medium 1 an ink ribbon 5 between them, the motor speed control means 9, based on this image data, activates and controls the paper feed motor 11 to rotate the platen roller 2; while the recording medium 1 and the ink ribbon 5 are moving with the rotation of the roller 2, the electric energy control means 10 selectively activates plural heating elements 3 of the line thermal head 4 to make them generate heat with specific levels of electric energy.

This changes the color of the recording medium 1 from white to black or transfers the thermal transfer inks 6 of the ink ribbon 5 to the recording medium 1 to record a desired image on it.

In short, recoding is done as follows depending on the color to be represented. For white, either the heating elements 3 are not turned on, or the thermal transfer inks 6 are not transferred and a very low level of electric energy which does not cause the recording medium 1 to turn black is supplied. For a color with R, G, and B inks, a certain level of electric energy is supplied so that the thermal transfer inks 6 are transferred and also the color of the recording medium 1 changes from white to gray. For black, a higher level of electric energy is supplied to cause the recording medium 1 to turn black.

In this way, the level of electric energy supplied to the heating elements 3 in the line thermal head 4 is controlled for each picture element so as to record a full color image.

In this case, because the position of each color (R, G, B) of the ink ribbon 5 must be recognized in order to transfer the R, G and B thermal transfer inks 6 of the ink ribbon 5 accurately, it is desirable to install a sensor or the like for identification of the thermal transfer inks 6 of the ink ribbon 5.

Therefore, in this embodiment, color change of the recording medium 1 and transfer of the thermal transfer inks 6 are controlled by controlling the electric energy supplied to the heating elements 3 in the line thermal head 4 to allow recording of a full color image, so that a full color image can be recorded through a single recording operation and the recording speed and the recording efficiency can be remarkably improved.

In addition, this kind of thermal transfer recording device requires less power. Therefore, even when it is of the portable battery-powered type, it consumes less battery power and does not cause inconvenience in use.

The present invention is not limited to the above embodiment; it can be embodied in other different forms as needed.

As explained so far, in a thermal transfer recording device according to the present invention, control means controls the electric energy supplied to heating elements in a thermal head in a way to bring its level into a white range, color range or black range depending on image data to record a full color image. In this way, recording of a full color image is performed through a single recording operation, which remarkably increases the recording speed and remarkably improves the recording efficiency with less power consumption.

Furthermore, a line thermal head is used as the thermal head and the ink ribbon used includes successive lines of R, G, and B thermal transfer inks extending along a row of heating elements in the line thermal head, so that full color images can be recorded in a line printer.

What is claimed is:

1. A thermal transfer recording device comprising a thermal head for recording a desired image on a recording medium, in which, while one of the thermal head and the recording medium is moving at a prescribed speed with the thermal head pressed against the recording medium with an ink ribbon bearing thermal transfer inks between the thermal head and recording medium, heating elements in the thermal head are selectively activated according to image data to make the heating elements generate heat in order to record the desired image, the recording device using, as the recording medium, a heat-sensitive recording medium which colors when heated and having control means to control electric energy supplied to the heating elements in the thermal head, wherein the control means control the electric energy supplied to the heating elements according to the image data in a way to bring a level into one of:

a white range in which the recording medium does not turn black and the thermal transfer inks of the ink ribbon are not transferred;

a color range in which the recording medium does not turn black and the thermal transfer inks are transferred; and a black range in which the recording medium turns black.

2. The thermal transfer recording device according to claim 1, wherein the thermal head is line thermal head, and wherein the ink ribbon includes successive lines of red, green, and blue thermal transfer inks extending along a row of heating elements in the line thermal head.

* * * * *